US006845543B2

(12) United States Patent
Kim

(10) Patent No.: US 6,845,543 B2
(45) Date of Patent: Jan. 25, 2005

(54) MOTOR HOUSING FOR VACUUM CLEANER

(75) Inventor: Sung-Guen Kim, Changwon Gyeongnam (KR)

(73) Assignee: LG Electronics, Inc., Seoul (KR)

( * ) Notice: Subject to any disclaimer, the term of this patent is extended or adjusted under 35 U.S.C. 154(b) by 329 days.

(21) Appl. No.: 10/127,606

(22) Filed: Apr. 23, 2002

(65) Prior Publication Data

US 2003/0115712 A1 Jun. 26, 2003

(30) Foreign Application Priority Data

Dec. 20, 2001 (KR) ..... 2001-82128

(51) Int. Cl.[7] ..... A47L 5/12
(52) U.S. Cl. ..... 15/412; 15/327.2
(58) Field of Search ..... 15/314, 327.1, 15/327.2, 327.6, 327.7, 353, 412

(56) References Cited

U.S. PATENT DOCUMENTS 2,122,632 A * 7/1938 Baxter ..... 280/8
3,619,850 A * 11/1971 Rideout et al. ..... 15/323
3,668,842 A * 6/1972 Batson et al. ..... 55/417
6,611,989 B2 * 9/2003 Oh et al. ..... 15/323

* cited by examiner

*Primary Examiner*—Terrence R. Till
(74) *Attorney, Agent, or Firm*—Fleshner & Kim, LLP

(57) ABSTRACT

A motor housing is provided which is configured to be installed within a main body of a vacuum cleaner. The motor housing includes a dust collection unit capable of filtering out foreign substances. The motor housing further comprises a casing, an upper portion of which is open, a cover hingedly coupled to a side of the casing for opening and closing the casing, a fastening device configured to maintain a state in which the cover of the casing is closed, a suction portion which is formed at a side surface of the casing and through which air can be introduced from the dust collection unit into the motor housing, and an exhaust portion which is formed at the other side surface of the casing and through which the air introduced into the motor housing can be exhausted to the exterior.

16 Claims, 3 Drawing Sheets

MOTOR HOUSING FOR VACUUM CLEANER

BACKGROUND OF THE INVENTION

1. Field of the Invention

The present invention relates to a vacuum cleaner, and more particularly, to a motor housing for a vacuum cleaner which is constructed such that a motor for generating suction power of the vacuum cleaner can be accommodated therein and an inner constitution of a main body of the vacuum cleaner can be simultaneously simplified.

2. Description of the Prior Art

Referring first to FIG. 1, the constitution of a conventional vacuum cleaner will be described.

As shown in this figure, a main body of the vacuum cleaner comprises an upper casing 110 and a lower casing 170 which form upper and lower portions of the main body, respectively. The upper and lower casing 110, 170 contain the following components therein.

A motor housing 160 and a dust collection unit 140 are installed at front and rear regions of a top surface of the lower casing 170, respectively. The dust collection unit 140 filters out foreign substances from air containing the foreign substances which has been introduced into the main body of the vacuum cleaner, and exhausts the filtered air via the motor housing 160 to the exterior.

Any types of dust collection units can be used for the dust collection unit 140 as far as they can filter out the foreign substances contained in the air which is drawn into the main body of the vacuum cleaner. For example, the dust collection unit 140 may be one capable of performing both a primary dust collection in a cyclone manner and a secondary dust collection by a filter.

Further, a driving motor 150 for generating suction power of the vacuum cleaner is mounted within the motor housing 160 installed at the front region of the lower casing 170. The motor housing 160 is formed to be open at an upper end thereof, and the suction power generated by the operation of the driving motor 150 mounted within the motor housing 160 causes the air containing the foreign substances such as dust to be introduced into the dust collection unit 140.

With the suction power generated as such, the air containing the foreign substances, which has been drawn through a suction nozzle, an extension tube and a connecting hose, is introduced into the main body of the vacuum cleaner via a suction portion 112 formed at a front region of the upper casing 110. Such introduced air is filtered in the dust collection unit 140 to remove the substances. The air from which the foreign substances have been removed is exhausted through an outlet 142 formed at an upper region of the dust collection unit 140 and then introduced into the motor housing 160. Since the motor housing 160 remains in a state where the upper end thereof is open, the air introduced through the open upper end passes through the driving motor 150 to remove heat therefrom and then is exhausted through an exhaust portion 162 formed at a side of the motor housing 160.

An intermediate cover 120 is installed above the dust collection unit 140 and the motor housing 160. The intermediate cover 120 is a part for simultaneously covering top faces of the motor housing 160 and the dust collection unit 140. The top face of the motor housing 160 is covered with a motor housing covering portion 124 on a side of the immediate cover 120 so that portions excluding a suction portion 125 and the exhaust portion 162 are hermetically closed and thus the suction power can be generated.

A pressure switch B is mounted in a switch mounting hole 128 of the immediate cover 120. The pressure switch B is configured to measure pressure in the motor housing 160 and to notify a user of abnormal status of the vacuum cleaner when the pressure is dropped.

The motor housing covering portion 124 for covering the top face of the motor housing is formed with a damper mounting hole 126 and the switch mounting hole 128 so as to communicate with the motor housing. A damper mounted in the damper mounting hole 126 is configured to be opened according to a difference in pressure between the top and bottom of the motor housing covering portion 124. When the pressure in the top of the immediate cover 120 is higher than that in the bottom thereof, the damper is opened so that the air is introduced into below the immediate cover 120 (i.e., into the motor housing).

According to the conventional constitution, the motor housing 160 comes into close contact with the motor housing covering portion 124 to define a space therebetween, and the suction power is generated by the driving motor 150 mounted in the space. Therefore, since the immediate cover 120 is required as an additional part, there is a disadvantage in that the number of parts in the main body of the vacuum cleaner is substantially increased.

Further, since the motor housing 160 and the immediate cover 120 are fastened with each other by using screws, there is another disadvantage in that such a fastening operation causes the entire productivity of the vacuum cleaner to be lowered.

SUMMARY OF THE INVENTION

The present invention is conceived to solve the above problems in the prior art. A primary object of the present invention is to provide a motor housing for a vacuum cleaner which is configured to implement a further simple inner constitution of a main body of the vacuum cleaner.

The motor housing for the vacuum cleaner according to the present invention for achieving the above object is installed within the main body of the vacuum cleaner including a dust collection unit capable of filtering out foreign substances. The motor housing comprises a casing of which an upper portion is open; a cover hingedly coupled to a side of the casing for opening and closing the casing; a fastening means for maintaining a state where the cover closes the casing; a suction portion which is formed at a side surface of the casing and through which air can be introduced from the dust collection unit into the motor housing; and an exhaust portion which is formed at the other side surface of the casing and through which the air introduced in the motor housing can be exhausted to the exterior.

According to one embodiment of the present invention, the fastening means comprises a latch installed at a rear end of the cover, and a latching protrusion installed on a rear surface of the casing so as to be fastened to the latch. Further, the fastening means may further comprise another latch installed at a lateral surface of the cover, and a latching protrusion installed at a lateral surface of the casing so as to be fastened to the latch.

According to another embodiment of the present invention, the suction portion is formed at a rear surface of the motor housing, and the exhaust portion is formed at a lateral surface of the motor housing.

According to a further embodiment of the present invention, a packing member for hermetically closing the casing is installed at a lower end of the cover which comes into contact with an upper end of the casing.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION OF THE PREFERRED EMBODIMENTS

Hereinafter, the present invention will be described in detail with reference to a preferred embodiment shown in the accompanying drawings.

Figure 1:
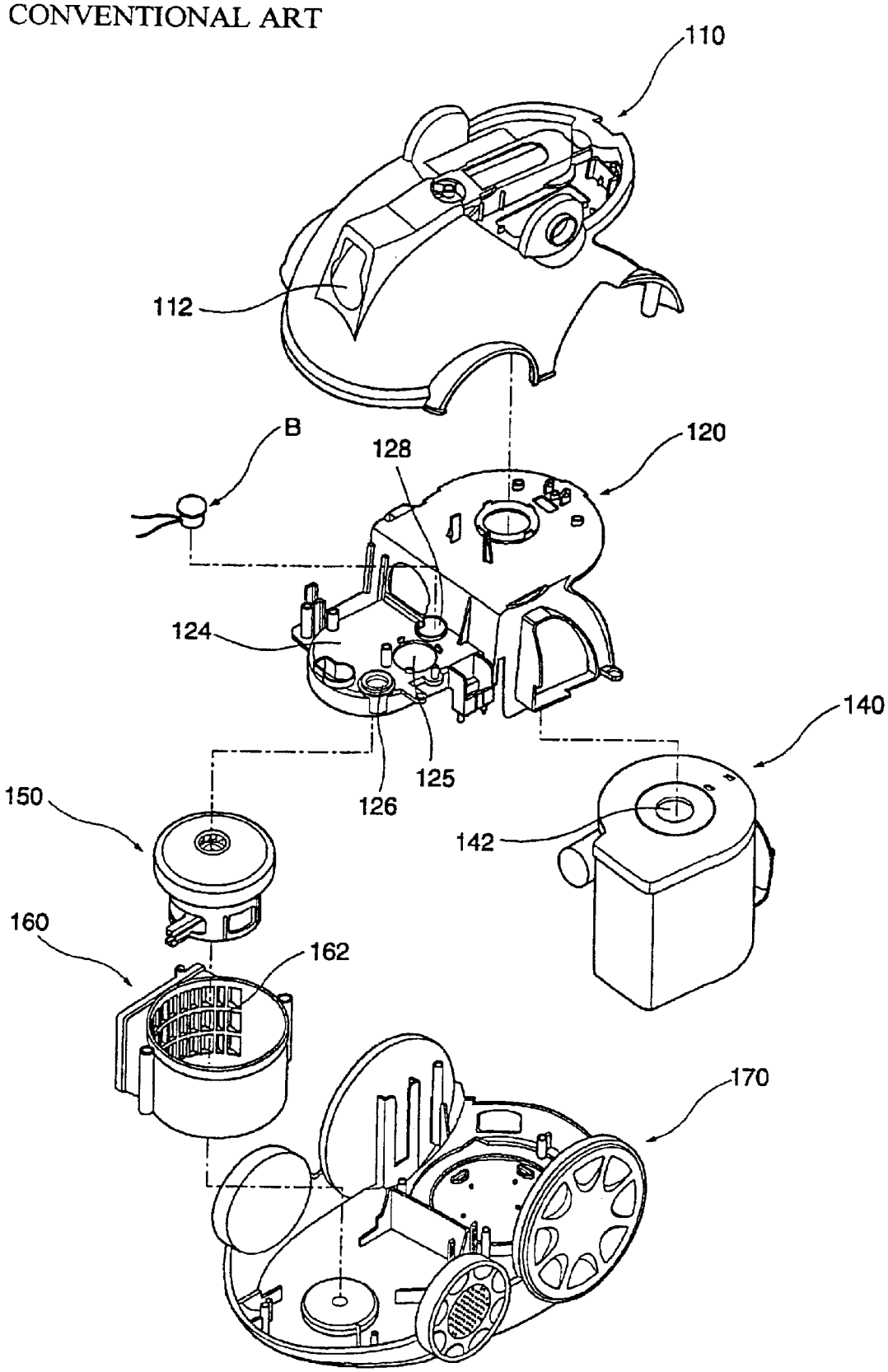
FIG. 1 CONVENTIONAL ART
FIG. 1 is an exploded perspective view of a conventional vacuum cleaner.
Figure 2:
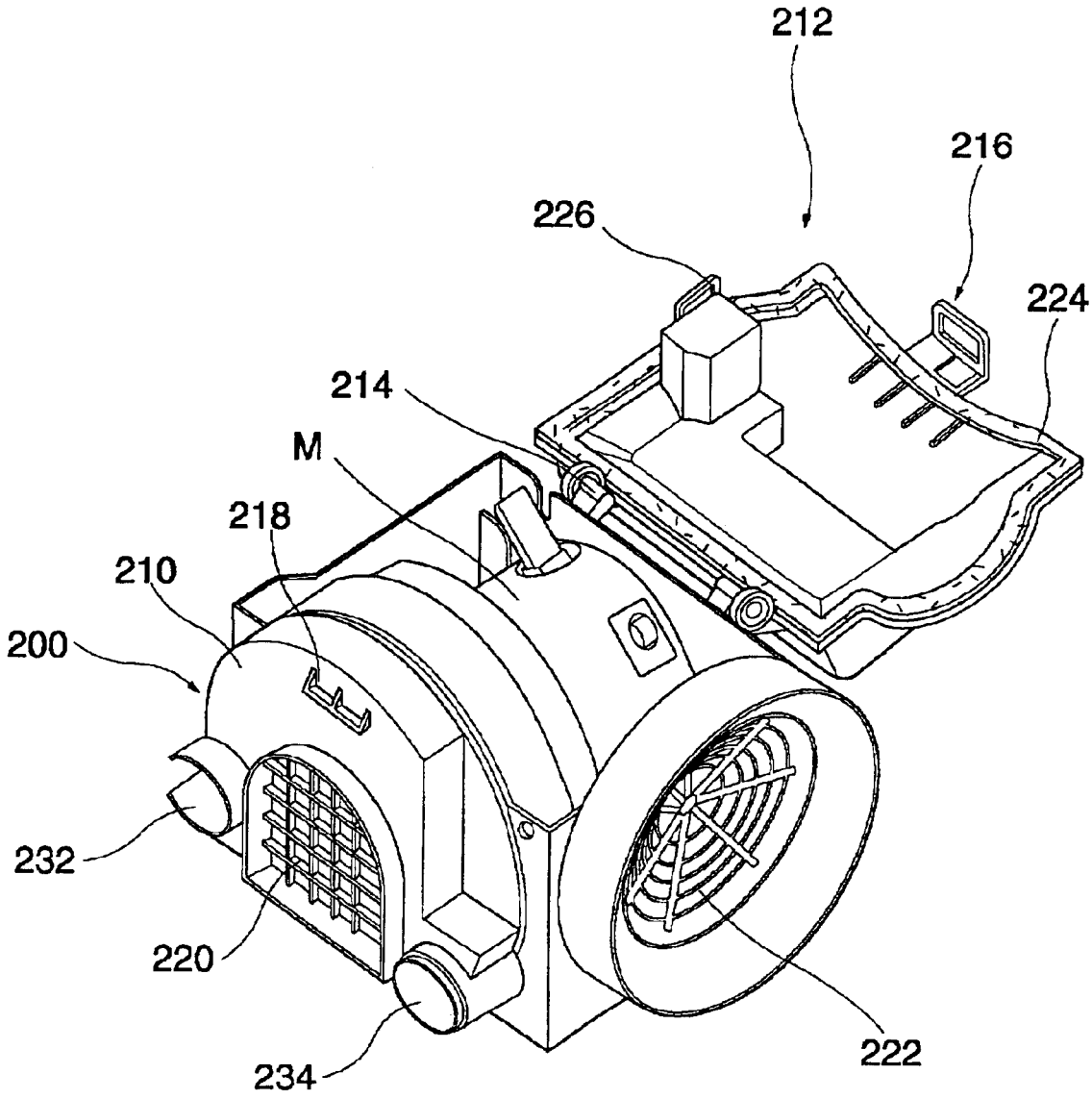
FIG. 2 is a rear perspective view of a motor housing for a vacuum cleaner according to the present invention.

Referring to FIG. 2 showing a rear perspective view of a motor housing for a vacuum cleaner according to the present invention, the motor housing 200 according to the present invention will be explained in detail. As shown in the figure, the motor housing 200 comprises a casing 210 of which an upper end is open, and a cover 212 for opening and closing the open upper end of the casing 210.

A motor M that is seated through the open upper end can be installed within the casing 210. The motor M is a part for generating suction power, which causes air containing foreign substances to be drawn, in the vacuum cleaner.

Further, a suction portion 220 including a plurality of vent holes is formed at a side (a rear surface in the illustrated embodiment) of the casing 210. The suction portion 220 is a portion through which the air with the foreign substances filtered out through a dust collection unit 260 shown in FIG. 3 passes into the motor housing 200. The air drawn through the suction portion 220 passes by and accordingly cools the motor M.

Moreover, an exhaust portion 222 including a plurality of vent holes is formed at another side (a lateral surface in the illustrated embodiment) of the casing 210. The exhaust portion 222 is a portion through which the air that has been introduced via the suction portion 220 into the motor housing 200 and then has cooled the motor M is exhausted. Then, the exhaust portion 222 allows the air to be exhausted through an exhaust portion 270 formed at a lateral surface of a main body of the vacuum cleaner.

The open upper end of the casing 210 is opened and closed by the cover 212. That is, since the cover 212 and the casing 210 are coupled with each other to be rotatable about a hinge shaft 214, the cover 212 can rotate about the hinge shaft 214 to open and close the casing 210.

Further, a latch 216 is formed at a rear end of the cover 212, and a latching protrusion 218 to which the latch 216 is fastened is formed on a rear end surface of the casing 210. Thus, when the cover 212 rotates about the hinge shaft 214 and covers the upper end of the casing 210, the latch 216 is fastened to the latching protrusion 218 so that the cover 212 can be maintained in a state where it closes the casing 210.

In addition to the latch 216 formed at the rear end, another latch 226 is formed at a lateral surface of the cover 212. When the cover 212 closes the casing 210, the latch 226 is fastened to a latching protrusion (not shown) formed at a lateral surface of the casing 210 so that the cover 212 can more firmly close the casing 210.

In such a state where the cover 212 closes the casing 210, the casing 210 excluding the suction portion 220 and the exhaust portion 222 should be completely hermetically closed. Accordingly, for ensuring the hermetical closing, a packing member 224 made of an elastic material such as sponge is attached to margins of a bottom surface of the cover 212. With such constitution, when the cover 212 closes the casing 210, their contact portions can be more firmly hermetically closed while the packing member 224 is compressed.

Furthermore, a side (the rear end surface in the illustrated embodiment) of the motor housing 200 according to the present invention is formed with a pressure switch mounting hole 232 in which a pressure switch for sensing pressure within the motor housing is mounted, and a damper mounting hole 234 in which a damper for introducing the air from the exterior into the motor housing upon reduction of the pressure in the motor housing is mounted.

Figure 3:
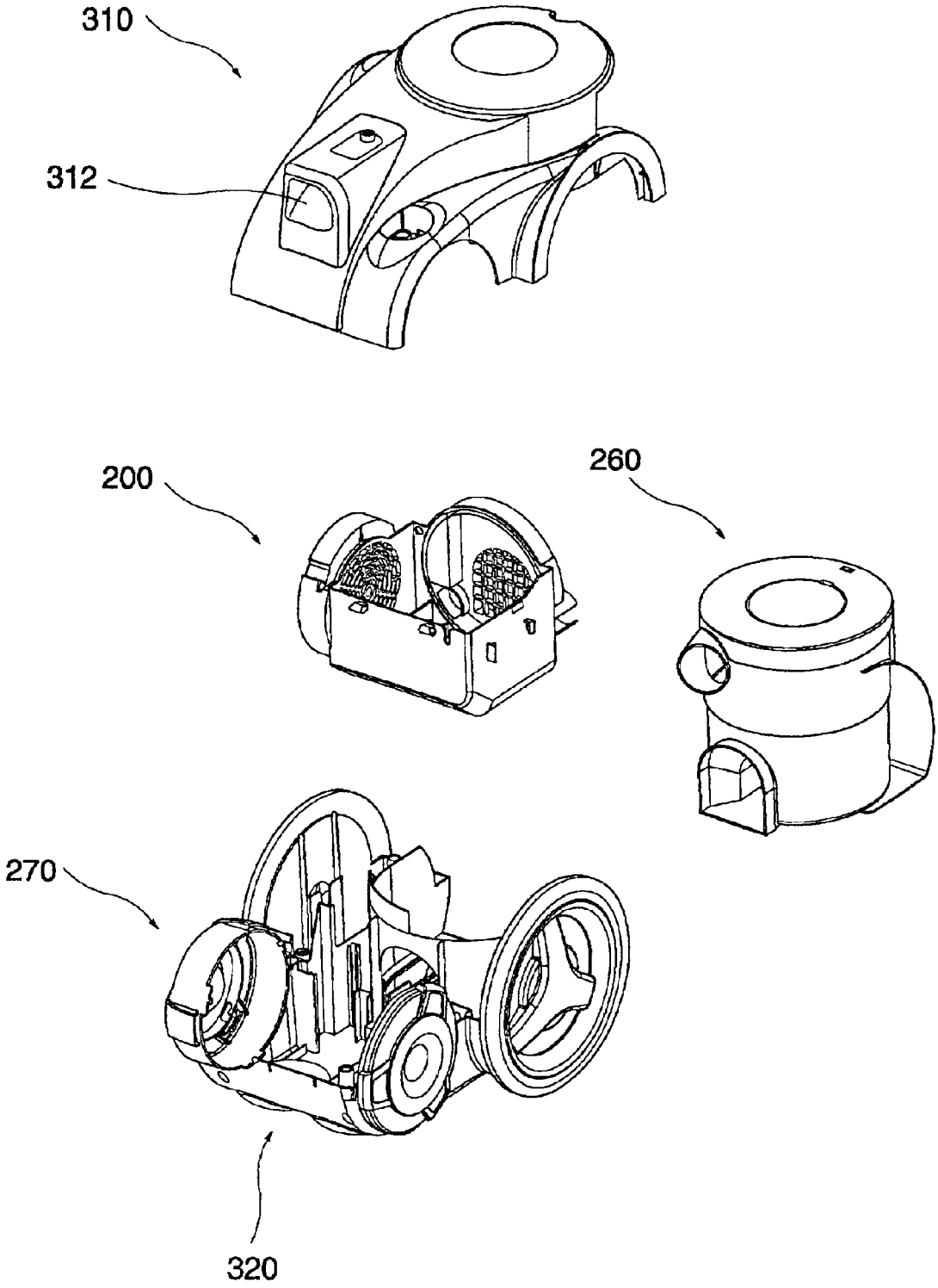
FIG. 3 is en exploded perspective view of the vacuum cleaner according to the present invention.

Next, the entire constitution of the main body of the vacuum cleaner including the motor housing 200 according to the present invention constructed as such will be described with reference to FIG. 3. In FIG. 3, the cover 212 for opening and closing the motor housing 200 is not illustrated.

As shown in the figure, the motor housing 200 according to the present invention is mounted between an upper casing 310 and a lower casing 320 of the main body of the vacuum cleaner. In practice, the motor housing 200 is fixed in a state where it is put on an upper surface of the lower casing 320, and the upper casing 310 which is positioned above the motor housing is fastened to the lower casing 320 by using screws.

Further, the dust collection unit 260 is detachably installed in the rear of the motor housing 200.

As can be understood from the above constitution, the motor housing 200 according to the present invention is mounted between the upper and lower casings 310, 320 and constructed to be hermetically closed at portions excluding the suction portion 220 and the exhaust portion 222. Therefore, since there is no need for an additional part for hermetically closing the motor housing, the motor housing of which the inner constitution is simplified as a whole can be implemented.

The entire operation of the vacuum cleaner will be explained. When the motor M is driven, the suction power is generated. With the suction power, the air containing the foreign substances is introduced through a suction nozzle, an extension tube, a connecting hose, and a suction inlet 312 formed at the upper casing. The introduced air enters the dust collection unit 260 where the foreign substances contained in the air are filtered out. Then, the filtered air enters the motor housing 200 through the suction portion 220. The air cools the motor within the motor housing and is then exhausted through the exhaust portion 222 to the exterior.

It can be understood from the above that a basic technical spirit of the present invention is to construct the motor housing in such a manner that it comprises the casing 210 of which the upper end is open and the cover 212 which is hingedly coupled to the casing 210 to open and close the casing.

As described above, the inner constitution of the main body of the vacuum cleaner can be more simply implemented by employing the motor housing according to the present invention. Therefore, reduction in the number of parts and improvement of productivity in assembly processes can be expected.

It will be apparent that those skilled in the art can make various changes and modifications within the scope of the technical sprit of the invention. Further, the present invention should be construed based on the appended claims.

What is claimed is:

1. A motor housing for a vacuum cleaner, which is configured to be installed within a main body of the vacuum cleaner adjacent to a dust collection unit capable of filtering out foreign substances, comprising;

a casing, an upper portion of which is open, and which is configured to receive therein a motor for the vacuum cleaner;

a cover hingedly coupled to a side of the casing for opening and closing the casing;

a fastening means for maintaining a state where the cover closes the casing;

a suction portion which is formed at a side surface of the casing and through which air can be introduced from the dust collection unit into the motor housing; and an exhaust portion which is formed at the other side surface of the casing and through which the air introduced in the motor housing can be exhausted to the exterior.

2. The motor housing as claimed in claim 1, wherein the fastening means comprises a latch installed at a rear end of the cover, and a latching protrusion installed on a rear surface of the casing so as to be fastened to the latch.

3. The motor housing as claimed in claim 2, wherein the fastening means further comprises another latch installed at a lateral surface of the cover, and a latching protrusion installed at a lateral surface of the casing so as to be fastened to said another latch.

4. The motor housing as claimed in claim 1, wherein the suction portion is formed at a rear surface of the motor housing, and the exhaust portion is formed at a lateral surface of the motor housing.

5. The motor housing as claimed in claim 1, wherein a packing member for hermetically closing the casing is installed at a lower end of the cover which comes into contact with an upper end of the casing.

6. The motor housing as claimed in claim 5, wherein the packing material comprises an elastic material.

7. The motor housing as claimed in claim 6, wherein the elastic material comprises a sponge.

8. A motor housing for a vacuum cleaner, comprising:

a casing configured to receive therein a motor for the vacuum cleaner and having a top, bottom, and four lateral sides, one of which is a front and one of which is a rear of the motor housing, wherein the top is substantially entirely open;

a cover hingedly coupled to one of the lateral sides of the casing for opening and closing the casing;

a fastening device configured to maintain a state in which the cover closes the casing;

a suction portion formed at one of the lateral sides of the casing and through which air can be introduced into the motor housing; and an exhaust portion formed at another of the lateral sides of the casing and through which the air introduced into the motor housing can be exhausted to the exterior.

9. The motor housing as claimed in claim 8, wherein the fastening device comprises a first latch installed on the cover, and a first latching protrusion installed on the casing.

10. The motor housing as claimed in claim 9, wherein the fastening device further comprises a second latch installed at a lateral side of the cover, and a second latching protrusion installed at a lateral side of the casing.

11. The motor housing as claimed in claim 8, wherein the suction portion is formed at a rear side of the motor housing, and the exhaust portion is formed at a lateral side surface of the motor housing.

12. The motor housing as claimed in claim 8, wherein a packing member configured to hermetically close the casing is installed on a lower surface of the cover and which is configured to come into contact with an upper edge of the casing.

13. The motor housing as claimed in claim 12, wherein the packing material comprises an elastic material.

14. The motor housing as claimed in claim 13, wherein the elastic material comprises a sponge.

15. A motor housing for a vacuum cleaner, which is installed within a main body of the vacuum cleaner including a dust collection unit capable of filtering out foreign substances, comprising:

a casing of which an upper portion is open;

a cover hingedly coupled to a side of the casing for opening and closing the casing;

a fastening means for maintaining a state where the cover closes the casing;

a suction portion which is formed at a side surface of the casing and through which air can be introduced from the dust collection unit into the motor housing; and an exhaust portion which is formed at the other side surface of the casing and through which the air introduced in the motor housing can be exhausted to the exterior, wherein the fastening means further comprises a latch installed at a rear end of the cover, and a latching protrusion installed on a rear surface of the casing so as to be fastened to the latch, and another latch installed at a lateral surface of the cover, and a latching protrusion installed at a lateral surface of the casing so as to be fastened to said another latch.

16. A motor housing for a vacuum cleaner, which is installed within a main body of the vacuum cleaner including a dust collection unit capable of filtering out foreign substances, comprising:

a casing of which an upper portion is open;

a cover for opening and closing the casing;

a suction portion which is formed at a lateral side surface of the casing and through which air can be introduced from the dust collection unit into the motor housing; and an exhaust portion which is formed at the other side surface of the casing and through which the air introduced in the motor housing can be exhausted to the exterior, wherein the suction portion is formed at a rear surface of the motor housing, and the exhaust portion is formed at a lateral surface of the motor housing.

* * * * *